US010675741B2

(12) United States Patent
Chiang

(10) Patent No.: US 10,675,741 B2
(45) Date of Patent: Jun. 9, 2020

(54) AUXILIARY DEVICE FOR ELECTRIC NAIL GUN HEADER STRUCTURE

(71) Applicant: Hsin Ying Enterprise Co., Ltd., Taichung (TW)

(72) Inventor: Wen Hung Chiang, Taichung (TW)

(73) Assignee: HSIN YING ENTERPRISE CO., LTD., Taichung (TW)

( * ) Notice: Subject to any disclaimer, the term of this patent is extended or adjusted under 35 U.S.C. 154(b) by 219 days.

(21) Appl. No.: 15/706,786

(22) Filed: Sep. 18, 2017

(65) Prior Publication Data

US 2019/0084138 A1 Mar. 21, 2019

(51) Int. Cl.

| | |
|---|---|
| ***B25C 7/00*** | (2006.01) |
| ***B25C 11/00*** | (2006.01) |
| ***B26B 15/00*** | (2006.01) |
| ***B25C 1/06*** | (2006.01) |
| ***B25F 3/00*** | (2006.01) |

(52) U.S. Cl.

CPC ..... *B25C 7/00* (2013.01); *B25C 1/06* (2013.01); *B25C 11/00* (2013.01); *B25F 3/00* (2013.01); *B26B 15/00* (2013.01)

(58) Field of Classification Search

CPC ..... B23D 29/00; B23D 29/005; B26B 15/00; B25F 3/00; B25C 1/06; B25B 21/007; Y10T 279/3406; Y10T 279/3412

USPC ..... 30/122, 210, 500; 173/29

See application file for complete search history.

(56) References Cited

U.S. PATENT DOCUMENTS

| | | | | |
|---|---|---|---|---|
| D513,953 | S * | 1/2006 | Peterson | B23D 29/00 D8/70 |
| 2005/0028391 | A1* | 2/2005 | Peterson | B23D 29/00 30/500 |
| 2011/0289998 | A1* | 12/2011 | Zhang | B23D 29/00 72/464 |
| 2014/0007433 | A1* | 1/2014 | Kochi | B23D 17/04 30/228 |
| 2016/0000449 | A1* | 1/2016 | Aman | B25F 3/00 173/217 |
| 2016/0023289 | A1* | 1/2016 | Moss | B23D 29/005 30/228 |
| 2016/0375510 | A1* | 12/2016 | Batho | B23D 29/005 30/194 |
| 2018/0257130 | A1* | 9/2018 | Chiang | B21J 15/105 |

* cited by examiner

*Primary Examiner* — Hemant Desai
*Assistant Examiner* — Christopher Robin Kim
(74) *Attorney, Agent, or Firm* — Leong C. Lei

(57) ABSTRACT

An auxiliary device for an electric nail gun header structure mainly inserts a head cover body adapted to position and lock a nail gun header with an extended locking frame; the end of the head cover body is used to cover the end of a gun body completely; the bottom of the head cover body is extend with two flange sheets opposite to each other to cover the two sides of a grip of the nail gun, forming particular, stable covering. Therefore, the head cover structure will not be displaced or rotated upon one-handed operation, thereby ensuring the convenience and safety of the operation of the nail gun.

3 Claims, 9 Drawing Sheets

AUXILIARY DEVICE FOR ELECTRIC NAIL GUN HEADER STRUCTURE

TECHNICAL FIELD OF THE INVENTION

The present invention relates to an auxiliary device for an electric nail gun header structure, and more particularly to a nail gun header positioning structure having stable clamping and capable of one-handed operation.

DESCRIPTION OF THE PRIOR ART

Among conventional nail gun header positioning assemblies, U.S. Pat. No. 7,093,365B2 discloses a "heavy duty drill shear attachment", in which drill shear attachment clamps for a shear attachment with shear blades connected to a chuck of a portable drill includes left and right rails extending from and secured to the left housing side of the shear attachment along the drill body to a point beyond the rear of the drill body to a rear end. A connector adjustably is fastened to the rear ends of the rails to adjustably draw the ends together for nonrotatable securing of the shear attachment to the drill for one-handed operation of the drill with the shear attachment in either a right side up or upside down drill orientation. However, the drill shear attachment clamps preventing the drill shear attachment from rotating with the chuck has the practical effect of lock-in-one, but the rails of the drill shear attachment clamps are not locked and positioned properly upon actual locking and assembly; the slidable grip pads on the middle parts of the rails and the connector adapted to lock the rear ends of the rails are used to allow the rails to secure about the body of a portable drill. Therefore, the securing is not good enough if the rails are slightly inclined. Especially, upon the one-handed operation of the drill with the shear attachment in upside down drill orientation as shown in FIG. 2, the end of the body of the portable drill may take the connector as a rotating center to turn downward and slip out, causing the operation to be dangerous; this is because clamping the two side of the drill body is not sufficient in clamping strength. Especially, the operation of a nail gun causes vibration, the nail gun is much easier to slip out in this situation.

SUMMARY OF THE INVENTION

To overcome the defects mentioned above, the present invention is proposed.

The main object of the present invention is to provide an auxiliary device for an electric nail gun header structure, in which a head cover body and locking frame are inserted with each other and capable of being carried out a telescopic adjustment after the front end of a locking frame is locked and fixed to a header through through holes on two sides thereof, allowing a curved inner edge of a head cover body to cover and press against an end of a gun body, flange pieces extended from two sides of the head cover body are directly pressed against two side faces of the grip on the bottom of the gun body to fix the two sides of the assembled head cover; with nuts locked from outside of the slide hole rack, the header is accurately conjoined with the gun body, thereby convenient for a safe operation with only one hand.

DETAILED DESCRIPTION OF THE PREFERRED EMBODIMENTS

Figure 1:
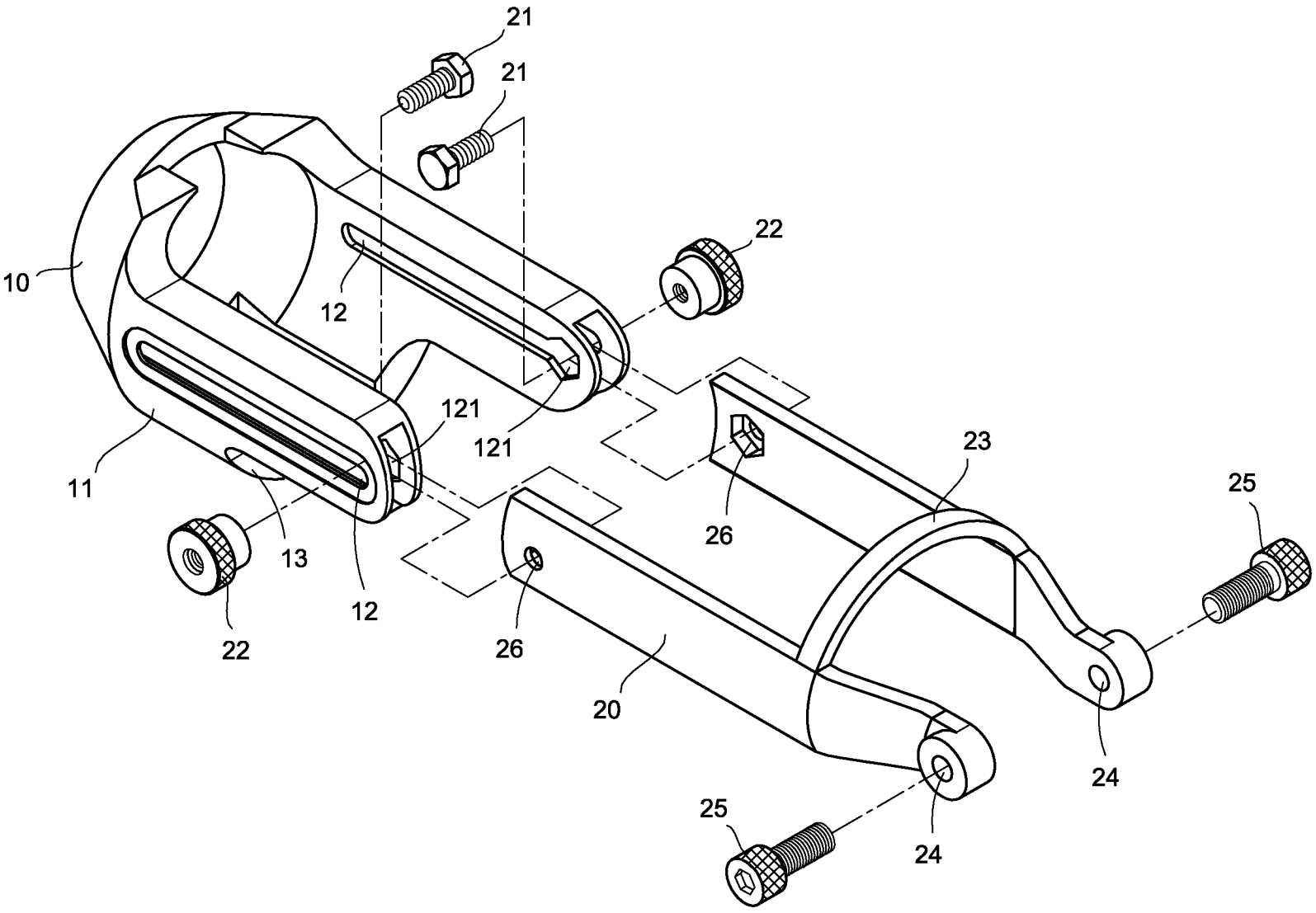
FIG. 1 is an exploded view of a positioning head cover structure of the present invention.
Figure 2:
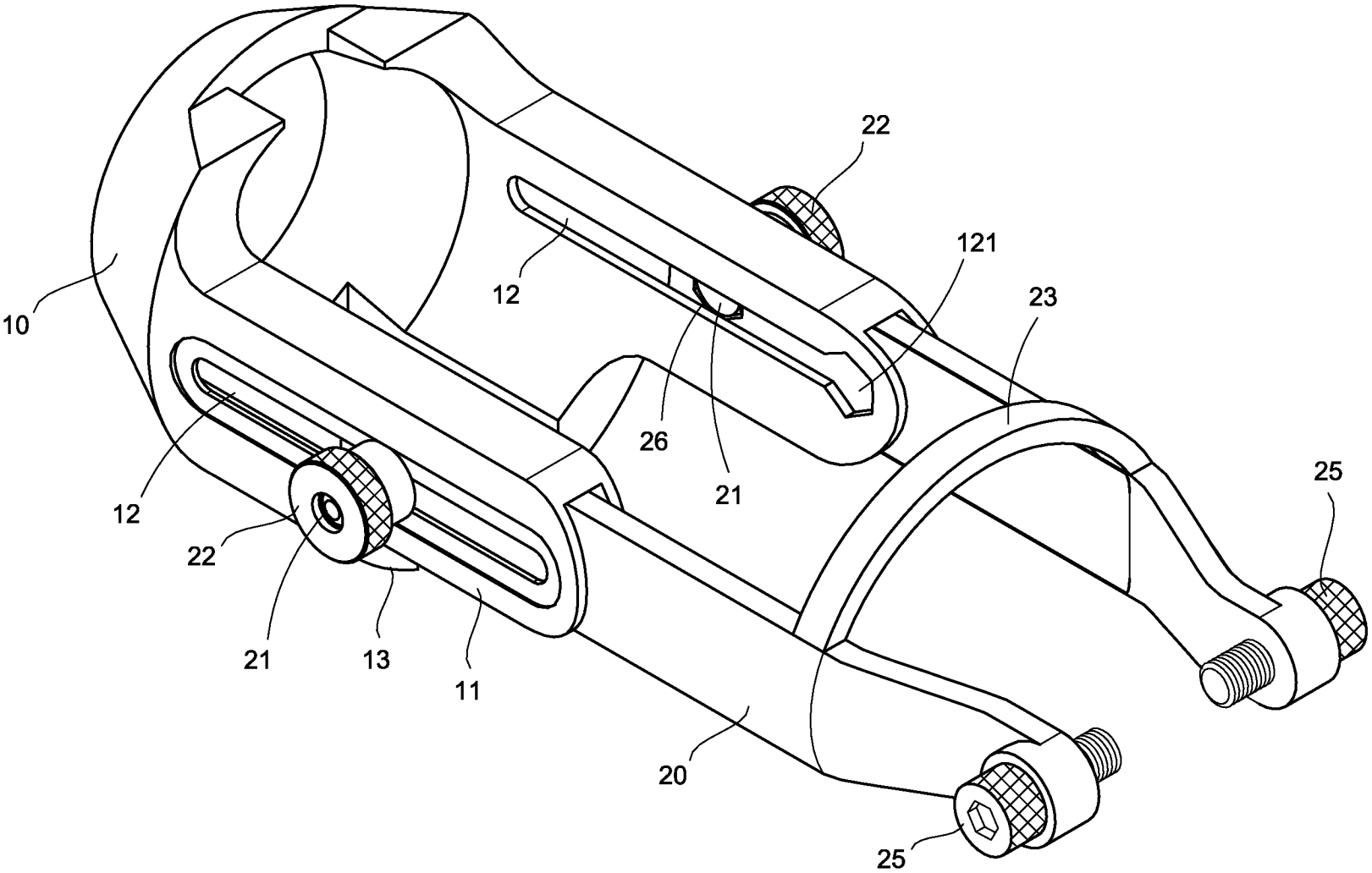
FIG. 2 is a perspective view of the head cover structure of the present invention.
Figure 3:
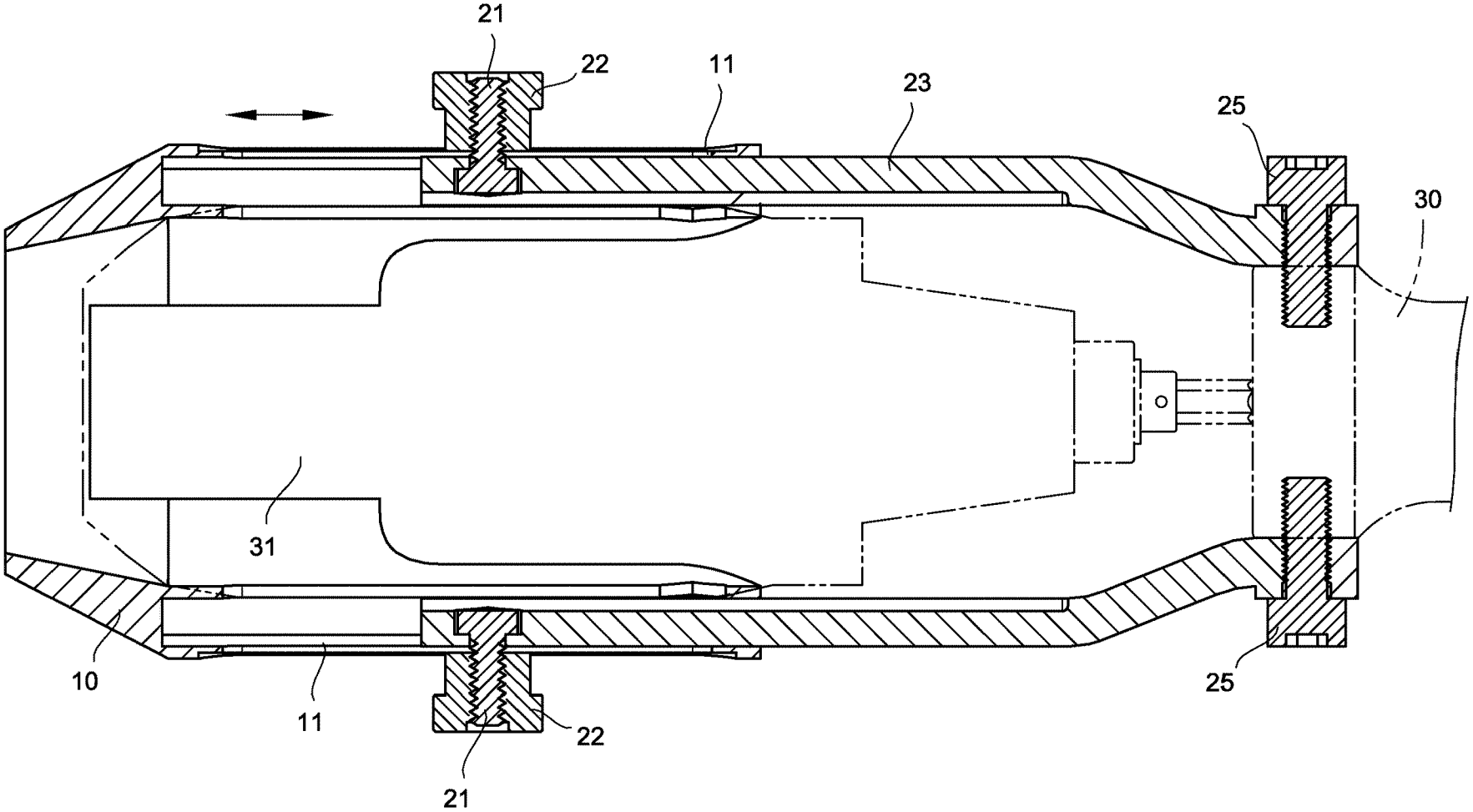
FIG. 3 is a cross-sectional view of the head cover structure of the present invention, where a gun body is shown.
Figure 4:
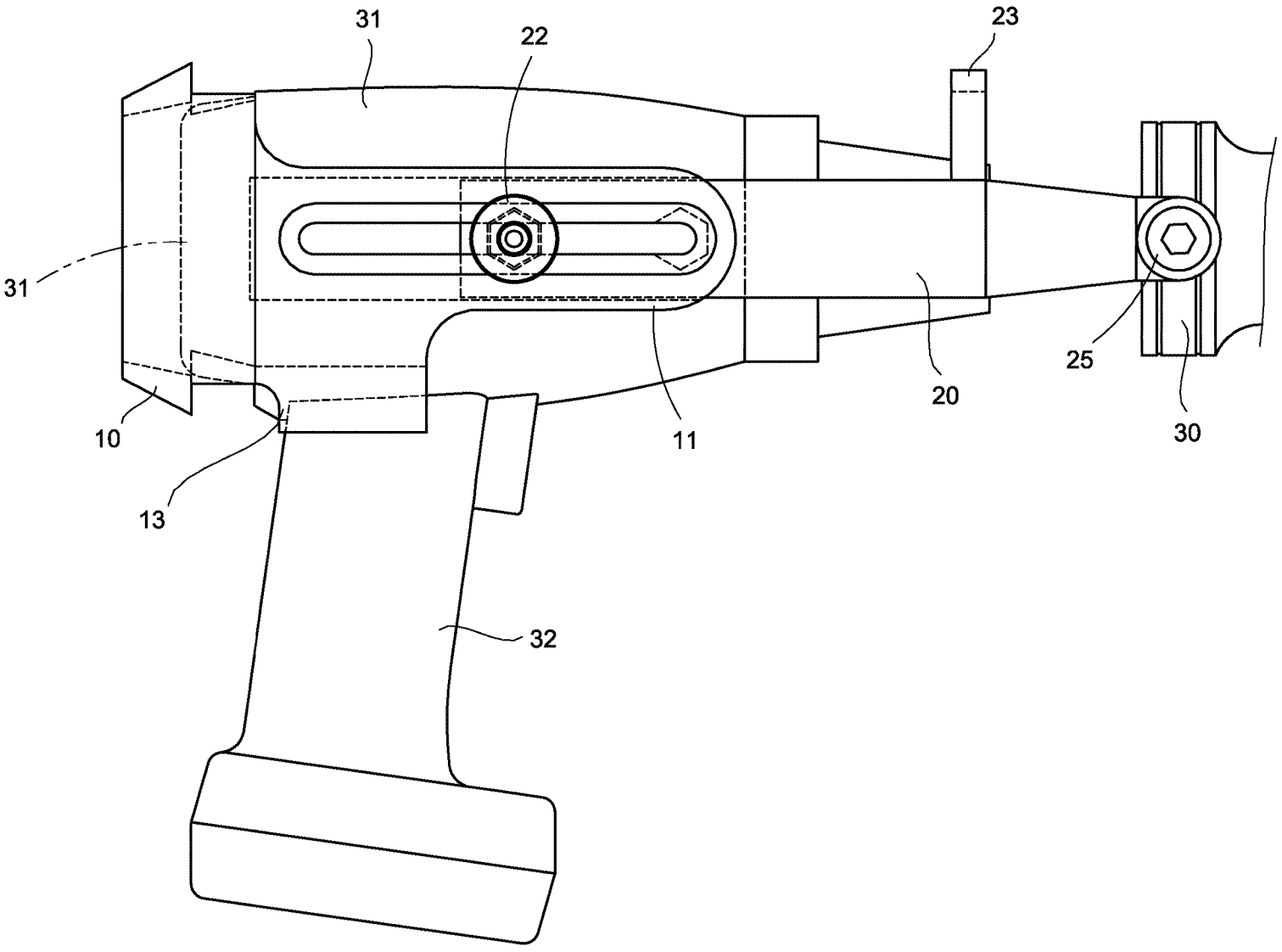
FIG. 4 is a schematic view of the head cover structure of the present invention assembled with a nail gun.
Figure 5:
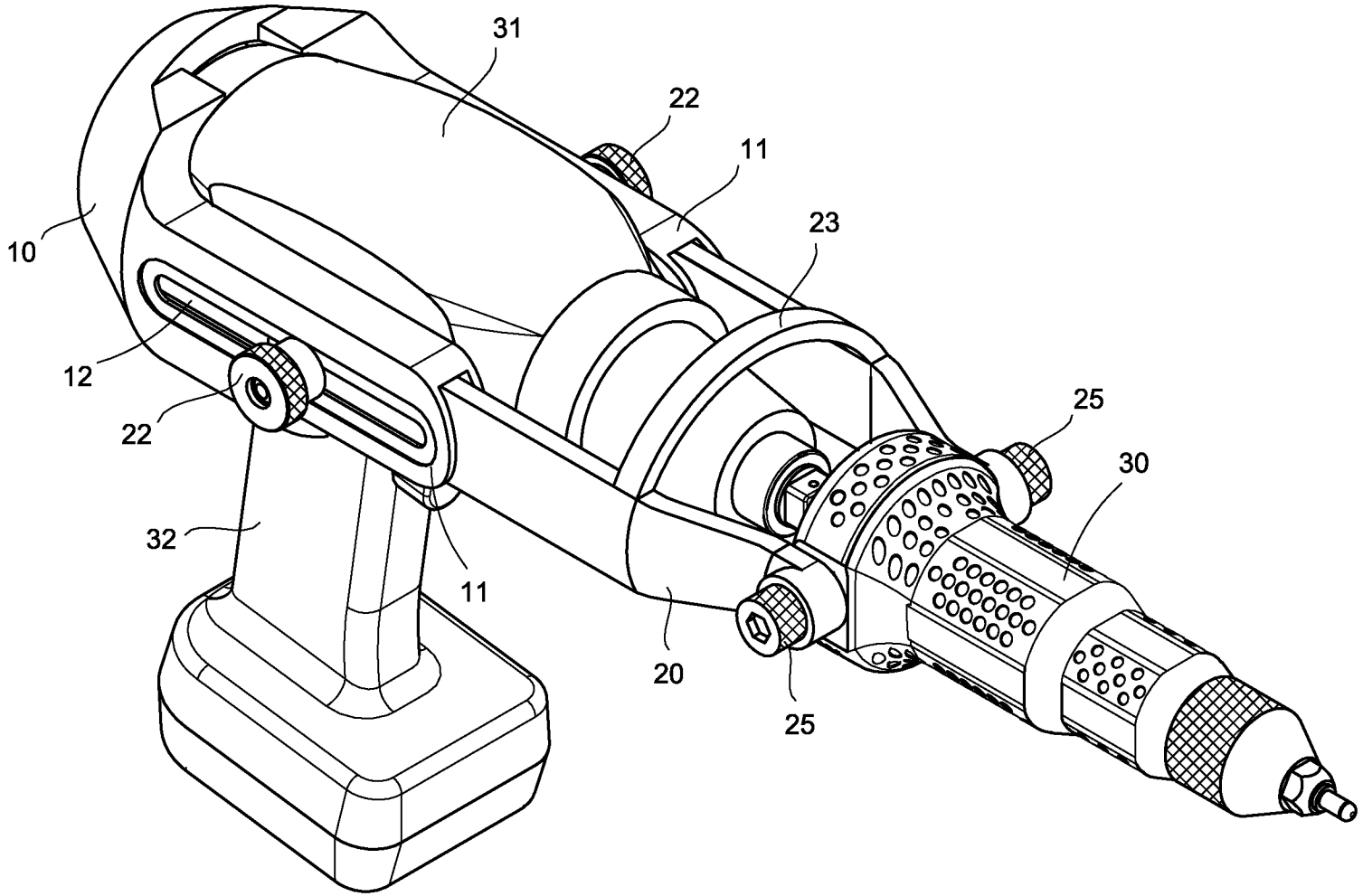
FIG. 5 is a perspective view of the head cover structure of the present invention assembled with a nail gun.

Referring to FIGS. 1 to 5, an auxiliary device for an electric nail gun header structure, taking the use of general electric nail guns as an example, includes a head cover body 10, one end of which is a covering arc end, the inner side of which is formed into a beveled rounded conic surface extended to form two opposite hollow slide hole racks 11, the inner and outer side plates of the rack body of each of which are respectively configured with a long slide hole 12, the two long slide holes 12 opposite to each other, and the front end of the long slide hole 12 configured on the inner side plate is configured with a through hole 121 with a larger diameter for a lock rod 21 to be inserted therein for the connection of the rack 11 with a locking frame 20 when the locking frame 20 is inserted in the gap between the inner and outer side plates and assembled there, where the lock rod 22 can be passed through the hollow inside of the slide hole rack 11 and engaged with a lock nut 22 form outside so that a complete head cover structure can be so constituted. Furthermore, the front edges of the two locking frames 20 are connected together by a curved butt bar 23, thereby constituting a conjoined lock frame which can be grasped conveniently upon insertion operation. Furthermore, the front ends of the two sides of the locking frame 20 are respectively configured with an end hole 24 allowing a bolt bar to be respectively engaged with the threaded holes on the two sides of an assembled header 30. Furthermore, a stepped hole 26 having a large diameter inside and small diameter outside is respectively configured on the rear edges of the locking frame 20, the two stepped holes 26 being opposite to each other, where the shape of the inner part of the through hole 26 is polygonal, allowing the similarly shaped head of the lock rod 21 to be positioned without rotation when the head of the lock rod 21 is embedded inside the inner part of the through hole 26 after the lock rod 21 is inserted is passed through the through hole 26 after the locking frame 20 is insert in the hollow inside of the slide hole racks 11, and a nut 22 may then be engaged with the lock rod 21 to retain the locking frame 20 inside the hollow insides of the slide hole racks 11. Whereby, the total length of the slide hole rack 11 and the locking frame 20 inserted therein can be adjusted only by unscrewing and then screwing nut 21 in engagement with the lock rod 21, allowing the assembly of the head cover body 10 to cover a gun body 31 to its whole length. Thereafter, the head cover body 10 is pressed from outside against the end of the covered gun body, allowing the inside of the arc edge of the head cover body 10 to be directly abutted against the end of the gun body 31, and enabling a flange pieces 13 extended from the two sides of the bottom of the head cover body 10 to clamp directly the two side faces of a grip 32 extended from the bottom of the gun body 31, thereby fixing the two sides of the assembled head cover body. With the assistance of the locking of the nuts 22 outside of the extended slide hole racks 11, it can ensure that the gun body 31 can be clamped and fixed accurately after one end of he head cover structure is engaged and fixed with the header 30, achieving a safe nail pulling operation with one single hand.

Figure 6:
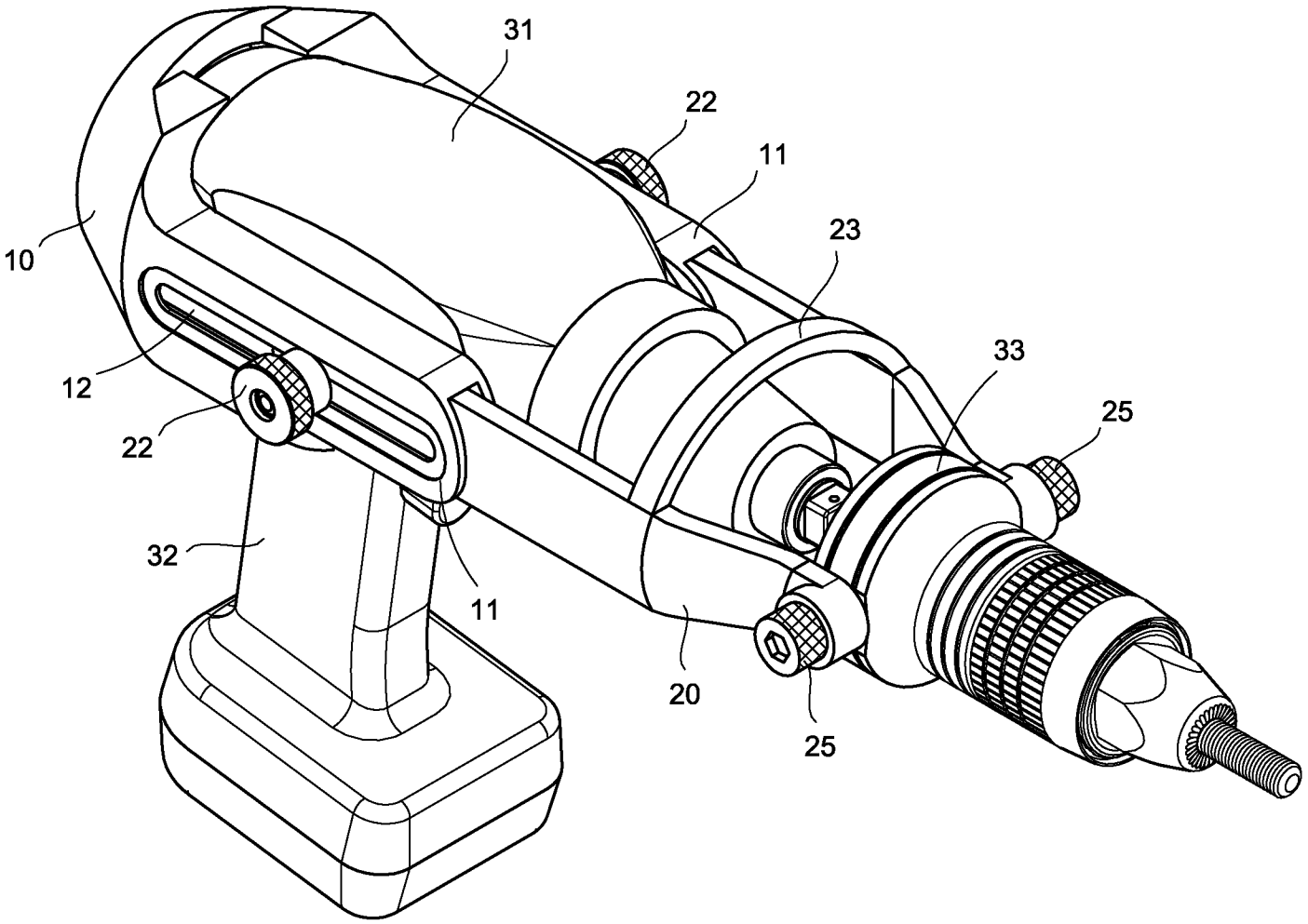
FIG. 6 is a perspective view of the head cover structure of the present invention assembled with a nail gun applied on an insert nut header.
Figure 7:
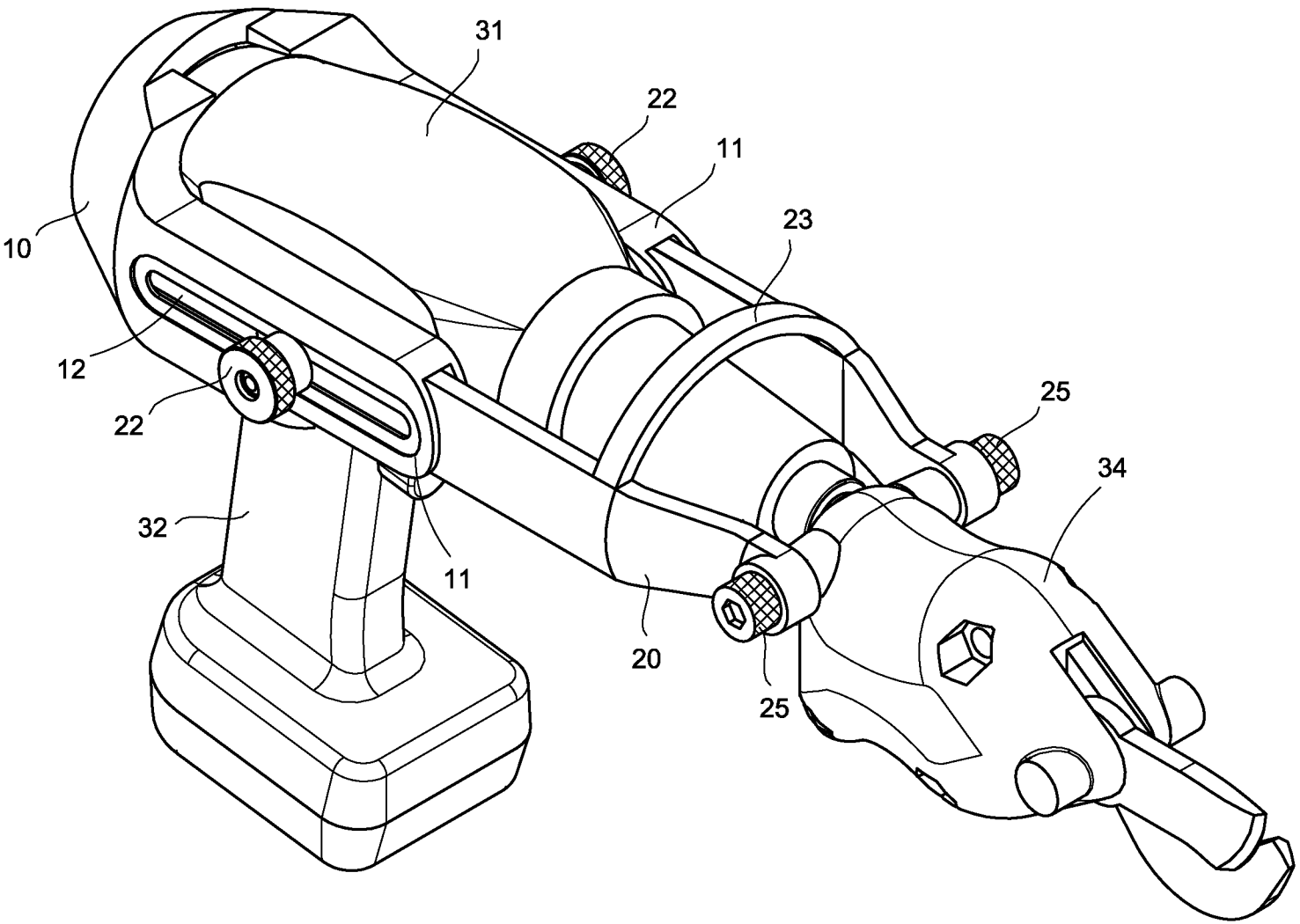
FIG. 7 is a perspective view of the head cover structure of the present invention assembled with a nail gun applied on an electric clipper.

The head cover structure for the positioning assistance of the header 30 covers the end of the gun body 31 completely with the head cover body 10. With the extended slide hole racks 11 inserted with the locking frame 20, the head cover assembly structure is allowed to cover any guns conveniently; the sliding hole rack 11 inserted with locking frame 20 can be extended or contracted safely and smoothly; the nut 22 can be in engagement with the lock rod 21 directly from the outside of the lock rod 21 after the head cover body 10 is pushed against the end of the covered gun body 31 because of the embedded insertion of the lock rod 21 and the telescopic adjustment of the locking frame 20 can thus be carried out, thereby positioning the header 30. In addition, the arc cover head of the head cover body 10 has a conical inside edge, convenient for abutting accurately against the end of a gun body 31 having a different end angle radian. In addition, the flange pieces 13 protruded from the bottom edge of the head cover body 10 form a clamping notch, which will clamp the outer top edges on the two sides of the grip 32 automatically when pushed, capable of avoiding the rotation of the assembled head cover body 10, thereby preventing any relative motion between the header 30 and gun body 31 and ensuring that the whole head cover structure 10 will not separate from the gun body 31, achieving a safe operation accurately; the covering locking and assembly with the entire head cover surely has the advantage of stable locking and assembly. On top of that, the present invention can be applied on a gun body 31 using electric or pneumatic device as a transmission control tool such as an insert nut header 33 shown in FIG. 6 and electric clipper shown in FIG. 7.

Figure 8:
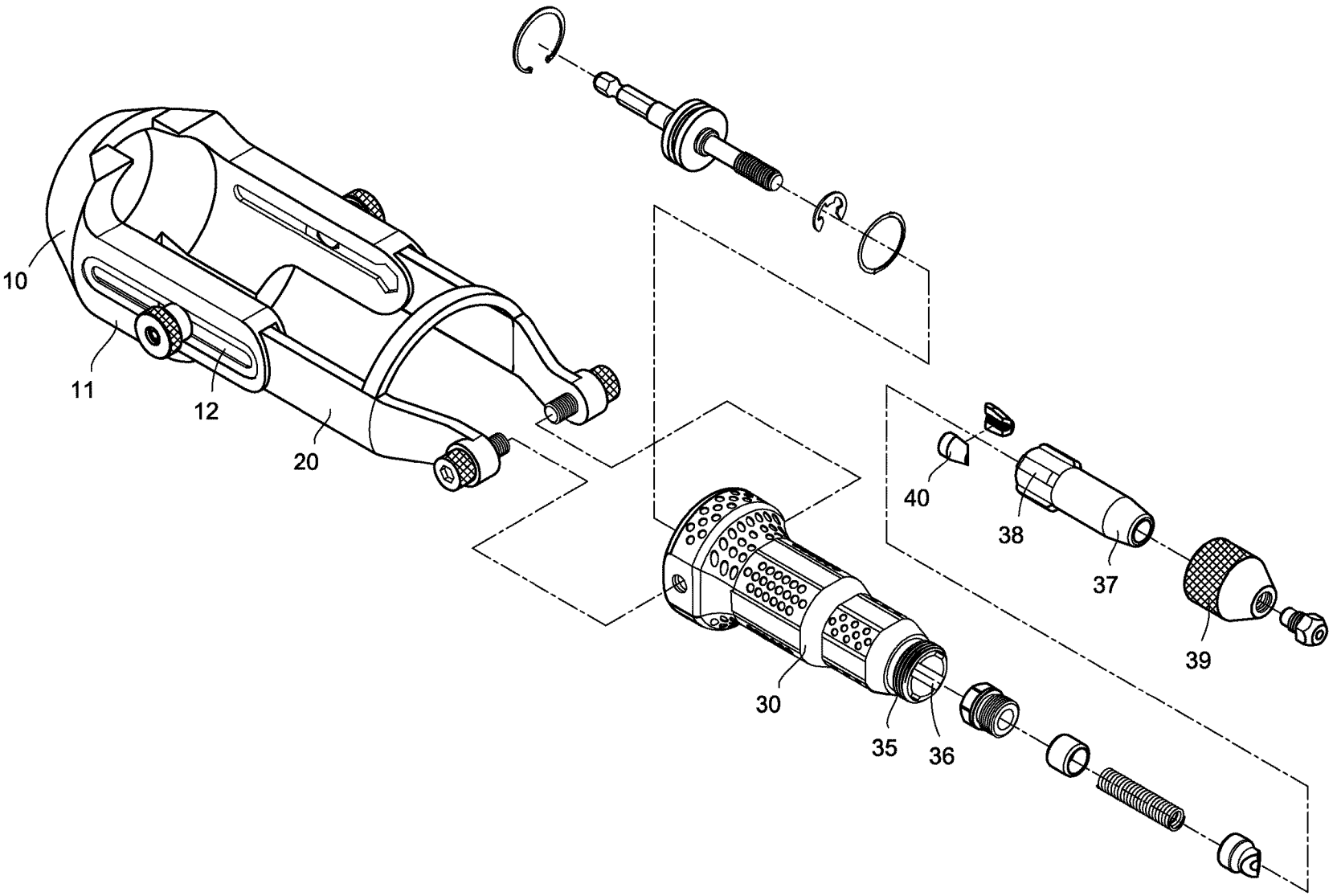
FIG. 8 is an exploded view of a nail gun header of the present invention.
Figure 9:
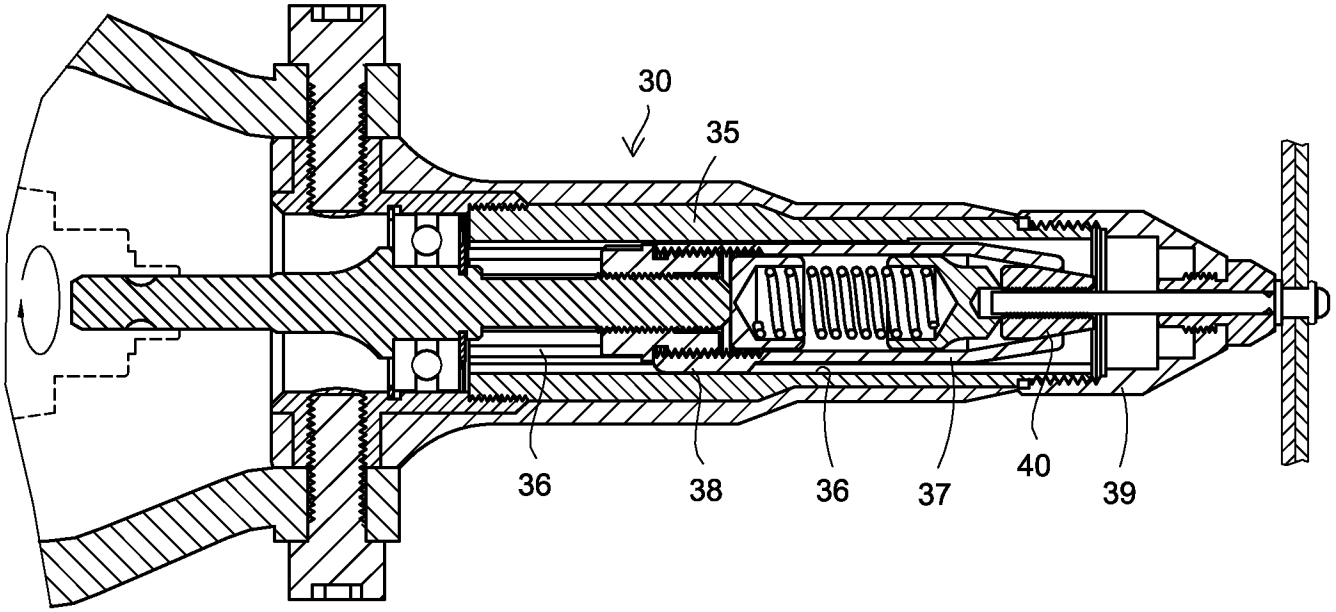
FIG. 9 is a cross-sectional view of the nail gun header of the present invention assembled with a slide element.

The nail gun header 30 of the present invention, as FIGS. 8 and 9 show, is configured inside thereof with a metal sliding sleeve, on the inner annular face of which are configured with sliding guide grooves 36 spaced equidistantly and extended up to the extended end of the conical head, the sliding sleeve 35 allowing a sliding element 37 to be directly inserted therein through the extended end, and the sliding guide grooves allowing a plurality of corresponding raised ribs configured on the sliding element 37 to be in engagement therewith; furthermore, the outside of the sliding sleeve 35 is in engagement with a conical head 39 and fixed thereby, allowing the assembly of the sliding element 37 to be substantially simplified, which is convenient for the sliding element 37 to be inserted in the header 30 from the front end extended out of the header 30, and more convenient for in-built clamping blocks 40 to be configured in response to different diameters of nail bars for pulling nails (generally having large and small two specifications, i.e. commonly used small nail bar of 2 to 5 millimeters and large nail bar of 6 to 8.5 millimeters); the clamping blocks 40 can be replaced simply only by detaching sliding element 37 after use or attrition, allowing the nail pulling operation of the entire nail gun to be more convenient and safe under the accurate clamping and safe use of the head cover.

I claim:

1. An auxiliary device for electric nail gun header structure, comprising: a gun body for power supply and grip on a bottom thereof for hand-grasping, a front end extend from said gun body and a header in connection with each other, and a positioning head cover structure for clamping said header and gun body together, said positioning head cover structure comprising:

a head cover body, one end thereof being a covering circular arc body, said head cover body extended with two opposite hollow slide hole racks each having inner and outer side plates respectively configured with an opposite long slide hole, a front end of said slide hole configured on said inner side plate configured with a larger size of through hole, two sides of a bottom of said head cover body respectively extended downward with a flange piece, said two flange pieces opposite to each other, forming an insertion notch on said bottom of said cover body; and a locking frame, a front edge thereof connected by a curved butt bar thereby constituting a conjoined lock frame, front ends of two side frame rods of said locking frame respectively configured with an end hole assembled with two sides of said header by locking a bolt, another end of each side frame rod is configured with an opposite a staged through hole for a lock rod to insert in said staged hole and a head of said lock rod to be embedded therein from inside to outside to lock said frame rods of said locking frame inserted in said hollow insides of said slide hole racks to said slide hole rack, and a nut used to be in engagement with said each lock rod from outside, thereby forming a complete head cover structure;

whereby, said head cover body and locking frame are inserted with each other and capable of being carried out a telescopic adjustment after said front end of locking frame is locked and fixed to said header through through holes on two sides thereof, allowing a curved inner edge of said head cover body to cover and press against an end of said gun body, said flange pieces extended from two sides of said head cover body are directly pressed against two side faces of said grip on said bottom of said gun body to fix said two sides of assembled head cover; with said nuts locked from outside of said slide hole rack, said header is accurately conjoined with said gun body, thereby convenient for a safe one-handed operation.

2. The device according to claim 1, wherein the shape of said staged hole on an inner side of said each frame rod of said locking frame is polygonal.

3. The device according to claim 1, wherein an inner surface of said covering circular arc end is an inclined conical face.

* * * * *